US008297237B2

(12) United States Patent
Barth et al.

(10) Patent No.: US 8,297,237 B2
(45) Date of Patent: Oct. 30, 2012

(54) HIGH INERTANCE LIQUID PISTON ENGINE-COMPRESSOR AND METHOD OF USE THEREOF

(75) Inventors: Eric J. Barth, Nashville, TN (US); Joel A. Willhite, Nashville, TN (US)

(73) Assignee: Vanderbilt University, Nashville, TN (US)

( * ) Notice: Subject to any disclaimer, the term of this patent is extended or adjusted under 35 U.S.C. 154(b) by 377 days.

(21) Appl. No.: 12/753,990

(22) Filed: Apr. 5, 2010

(65) Prior Publication Data

US 2010/0252009 A1 Oct. 7, 2010

Related U.S. Application Data

(60) Provisional application No. 61/167,059, filed on Apr. 6, 2009.

(51) Int. Cl.
*F02B 75/00* (2006.01)

(52) U.S. Cl. ..... 123/19; 92/34; 92/37; 92/47; 92/49; 92/53

(58) Field of Classification Search ..... 123/19; 92/34, 37, 47, 49, 53
See application file for complete search history.

(56) References Cited

U.S. PATENT DOCUMENTS 4,543,044 A * 9/1985 Simmons ..... 417/342
6,182,615 B1 * 2/2001 Kershaw ..... 123/19
7,191,738 B2 * 3/2007 Shkolnik ..... 123/19
7,350,483 B2 * 4/2008 Atkins, Sr. ..... 123/19

OTHER PUBLICATIONS

Riofrio, Jose A., Barth, Eric J., "Design and analysis of a resonating free liquid-piston engine compressor", 2007 ASME International Mechanical Engineering Congress and Exposition, pp. 1-8, Nov. 11-15, 2007, Seattle, Washington.
Goldfarb, Michael, Barth, Eric J., Gogola, Michael A., Wehrmeyer, Joseph A., "Design and Energetic Characterization of a Liquid-Propellant-Powered Actuator for Self-Powered Robots", IEEE/ASME Transactions on Mechatronics, vol. 8, No. 2, pp. 254-262, Jun. 2003.
Yong, Chao, Barth, Eric J., Riofrio, Jose A., "Modeling and Control of a Free Liquid-Piston Engine Compressor", Bath/ASME Symposium on Fluid Power and Motion Control (FPMC 2008), pp. 245-257, Sep. 10-12, 2008, Bath U.K.
Dunn-Rankin, Derek, Leal, Elisangela Martins, Walther, David C., "Personal power systems", Progress in Energy and Combustion Science 31 (2005), pp. 422-465.
Kuribayashi, K., "Criteria for the evaluation of new actuators as energy converters", Advanced Robotics, vol. 7, No. 4, pp. 289-307 (1993).
Richer, Edmond, Hurmuzlu, Yildirim, "A High Performance Pneumatic Force Actuator System: Part 1—Nonlinear Mathematical Model", American Society of Mechanical Engineers, Transactions of the ASME , vol. 122 , pp. 416-425 , Sep. 2000.
Riofrio, Jose A., Barth, Eric J., A Free Piston Compressor as a Pneumatic Mobile Robot Power Supply: Design, Characterization and Experimental Operation:, International Journal of Fluid Power 8 (2007) No. 1, pp. 17-28.

* cited by examiner

*Primary Examiner* — Nathan Wiehe
*Assistant Examiner* — Hung Q Nguyen
(74) *Attorney, Agent, or Firm* — Wyatt, Tarrant & Combs, LLP

(57) ABSTRACT

A high inertance liquid piston engine-compressor that is lightweight, portable and for use with pneumatically actuated devices that may have periods of inactivity between periods of pneumatic use. The engine-compressor provides a power generation system that is for use with mobile or portable devices which need a portable long lasting energy source.

21 Claims, 9 Drawing Sheets

HIGH INERTANCE LIQUID PISTON ENGINE-COMPRESSOR AND METHOD OF USE THEREOF

This application claims the benefit of U.S. Provisional Patent Application Ser. No. 61/167,059, filed Apr. 6, 2009, entitled "High Inertance Liquid Piston" which is hereby incorporated by reference in its entirety.

STATEMENT REGARDING FEDERALLY SPONSORED RESEARCH OR DEVELOPMENT

This invention was made, in part, with federal grant money under the National Science Foundation grant number 0540834. The United States Government has certain rights in this invention.

REFERENCE TO A MICROFICHE APPENDIX

Not applicable

BACKGROUND OF THE INVENTION

Energetic limitations have long plagued the development of compact and lightweight untethered power supplies for applications involving powered hand tools, powered yard equipment, or human-scale robotic systems. As an example, the need for an effective portable power supply for human-scale robots has increasingly become a matter of interest in robotics research. Current prototypes of humanoid robots, such as the Honda P3, Honda ASIMO and the Sony QRIO, show significant limitations in the capacity of their power sources in between charges (the operation time of the humanoid-size Honda P3, for instance, is only 20 to 25 minutes). Given the low energy density of state-of-the-art rechargeable batteries, operational times of these systems in the 100 W range are restrictive. Dunn-Rankin, D., Martins, E., and Walther, D., 2005. "Personal Power Systems". *Progress in Energy and Combustion Science,* 31, August, pp. 422-465. This limitation becomes a strong motivation for the development and implementation of a more adequate source of power. Moreover, the power density of the actuators coupled to the power source needs to be maximized such that, on a systems level evaluation, the combined power supply and actuation system is both energy and power dense. Put simply, state-of-the-art batteries are too heavy for the amount of energy they store, and electric motors are too heavy for the mechanical power they can deliver, in order to present a viable combined power supply and actuation system that is capable of delivering human-scale mechanical work in a human-scale self contained robot package, for a useful duration of time. Goldfarb, M., Barth, E. J., Gogola, M. A., Wehrmeyer, J. A. 2003. Design and Energetic Characterization of a Liquid-Propellant-Powered Actuator for Self-Powered Robots, *IEEE/ASME Transactions on Mechatronics*, Vol. 8, no. 2, pp. 254-262.

The total energetic merit of an untethered power supply and actuation system, this system being an untethered robot, portable powered hand tools, or similar systems, is a combined measure of 1) the source energy density of the energetic substance being carried, 2) the efficiency of conversion to controlled mechanical work, 3) the energy converter mass, and 4) the power density of the actuators. With regard to a battery powered electric motor actuated system, the efficiency of conversion from stored electrochemical energy to shaft work after a gear head can be high (~50%) with very little converter mass (e.g. PWM amplifiers); however, the energy density of batteries is relatively low (about 350 kJ/kg specific work for Li-ion batteries after the gearhead), and the power density of electrical motors is not very high (on the order of 50 W/kg), rendering the overall system heavy in relation to the mechanical work that it can output. One approach to address the problems of low energy density batteries and low power density actuators is to avoid the electromechanical domain and utilize the pneumatic domain.

With regard to a hydrocarbon-pneumatic power supply and actuation approach relative to the battery/motor system, the converter mass is high and the total conversion efficiency is shown to be lower. However, the energy density of hydrocarbon fuels, where the oxidizer is obtained from the environment and is therefore free of its associated mass penalty, is in the neighborhood of 45 MJ/kg, which is about 2 orders of magnitude greater than the energy density of state of the art electrical batteries. This implies that even with poor conversion efficiency (poor but within the same order of magnitude), the available energy to the actuator per unit mass of the energy source is still at least one order of magnitude greater than the battery/motor system. Additionally, pneumatic actuators have approximately an order of magnitude better volumetric power density and a five times better mass specific power density (Kuribayashi, K. 1993. Criteria for the evaluation of new actuators as energy converters, *Advanced Robotics*, Vol. 7, no. 4, pp. 289-37) than state of the art electrical motors. Therefore, the combined factors of a high energy-density fuel, the efficiency of the device, the compactness and low weight of the device, and the use of the device to drive lightweight pneumatic actuators (lightweight as compared with power comparable electric motors) is projected to provide at least an order of magnitude greater total system energy density (power supply and actuation) than state of the art power supply (batteries) and actuators (electric motors) appropriate for human-scale power output.

With regard to the scale of interest, the main loss mechanisms for mechanical small-scale power generation devices are dominated by surface related effects: primarily viscous friction, coulomb friction, leakage, quenching, and heat loss. Given that all of these mechanisms are surface effects, they become more dominant at smaller scales as the surface area to volume ratio becomes higher. This is the primary reason conventional internal combustion engines have single digit efficiencies below the 1 kW scale. To overcome these loss mechanisms, a power generation device that minimizes as many of these surface effects resulting in higher efficiency is needed.

SUMMARY OF THE INVENTION

The present invention discloses a high inertance engine-compressor for use with pneumatically actuated devices. The present invention is a small-scale power supply. The invention overcomes problems of traditional small-scale power supplies, as further described herein. This high inertance engine-compressor is light weight, untethered and does not need to be in a state of "idle" that consumes energy without delivering useful work.

Disclosed herein is an embodiment of a liquid piston engine-compressor, including a liquid piston, the liquid piston further including a tube having a first end and a second end, a first transition member attached to the first end of the tube, a second transition member attached to the second end of the tube, a first diaphragm attached to the first transition member, a second diaphragm attached to the second transition member, so that the first diaphragm and the second diaphragm trap a fluid in the tube, an engine head attached to the first diaphragm of the liquid piston, wherein the engine head and the diaphragm define a variable volume combustion chamber, wherein the engine head defines an opening so that a compressed air-fuel mixture of at least 20 psig may pass therethrough, an ignition device attached to the engine head in order to combust the air-fuel mixture in the combustion chamber, an exhaust valve attached to the engine head so that combustion byproducts pass through the engine head when the exhaust valve opens, a variable volume compression chamber, the compression chamber further including a housing attached to the second diaphragm of the liquid piston, opposite the second transition member, an inlet valve attached to the housing, an outlet valve attached to the housing, a reservoir, the reservoir further including a first tube attached to the variable volume compression chamber, a reservoir body attached to the first tube, wherein the reservoir body is pressurized to at least 20 psig by the compression chamber, a second tube attached to the reservoir body so that pressurized air is released for use, a third tube attached to the reservoir body so that pressurized air is released to an air/fuel mixing circuit, an air/fuel mixing circuit attached to the third tube and an air/fuel line attached to the mixing circuit in order to provide air/fuel for combustion in the combustion chamber. In certain embodiments, the liquid piston engine-compressor further includes a fuel chamber, wherein the fuel chamber is pressurized to at least 20 psig, and a tube attached to the fuel chamber and the air/fuel mixing circuit.

In certain embodiments, the first diaphragm is a silicone rubber and the second diaphragm is an elastomeric material. In other embodiments, the first diaphragm is a metal bellows. In other embodiments, the volume of the first transition member is at least equal to a volume of the compression chamber. In still other embodiments, the weight of the engine-compressor is in a range of from about 1 pound to about 20 pounds. In certain embodiments, the tube of the liquid piston has a ratio of length to diameter of at least 10, and the tube of the liquid piston has a pressure rating of at least 200 psig. In other embodiments, the tube of the liquid piston is a thin-walled metal or a flexible high-pressure tubing. In yet other embodiments, the tube of the liquid piston has an inner diameter less than a largest inner diameter of either transition member. In certain embodiments, the first diaphragm and the second diaphragm have stiffness of from about 0.2 $Pa/mm^3$ to about 200 $Pa/mm^3$.

In other embodiments of the liquid piston engine-compressor, the first diaphragm and the second diaphragm are oriented so that they flex in opposition of each other in response to combustion in the combustion chamber. In yet other embodiments, the first transition member has a first end and a second end, wherein the first end of the first transition member attaches to the first end of the tube of the liquid piston and the second end of the first transition member is opposite of the first end of the first transition member, wherein the ratio of the cross sectional area of the second end of the first transition member to the cross sectional area of the tube of the liquid piston is from about 2 to about 1000. In still other embodiments, the second transition member has a first end and a second end, wherein the first end of the second transition member attaches to the first end of the tube of the liquid piston and the second end of the second transition member is opposite of the first end of the second transition member, wherein the ratio of the cross sectional area of the second end of the second transition member to the cross sectional area of the tube of the liquid piston is from about 2 to about 1000. Still other embodiments further include a compressed natural gas fuel injector. Yet other embodiments further include an inlet valve attached to the engine head so that the combustion chamber is connected to ambient air.

In another embodiment disclosed herein, the liquid piston engine-compressor includes a liquid piston, the liquid piston further includes a tube having a first end and a second end, a first transition member attached to the first end of the tube, a second transition member attached to the second end of the tube, a first diaphragm attached to the first transition member, a solid piston slidably engaging the second transition member, so that the first diaphragm and the solid piston trap a fluid in the tube, an engine head attached to the first diaphragm of the liquid piston, wherein the engine head and the diaphragm define a variable volume combustion chamber, wherein the engine head defines an opening so that a compressed air-fuel mixture of at least 20 psig may pass therethrough, an ignition device attached to the engine head in order to combust the air-fuel mixture in the combustion chamber, an exhaust valve attached to the engine head so that combustion byproducts pass through the engine head when the exhaust valve opens, a variable volume compression chamber, the compression chamber further including a housing attached to the solid piston of the liquid piston, opposite the second transition member, an inlet valve attached to the housing, an outlet valve attached to the housing, a reservoir, the reservoir further including a first tube attached to the variable volume compression chamber, a reservoir body attached to the first tube, wherein the reservoir body is pressurized to at least 20 psig by the compression chamber, a second tube attached to the reservoir body so that pressurized air is released for use, a third tube attached to the reservoir body so that pressurized air is released to an air/fuel mixing circuit, an air/fuel mixing circuit attached to the third tube, and an air/fuel line attached to the mixing circuit in order to provide air/fuel for combustion in the combustion chamber.

In yet another embodiment disclosed herein, the liquid piston engine-compressor, includes, a liquid piston, the liquid piston further including a tube having a first end and a second end, a first transition member attached to the first end of the tube, a second transition member attached to the second end of the tube, a first solid piston slidably engaging the first transition member, a second solid piston slidably engaging the second transition member, so that the first solid piston and the second solid piston trap a fluid in the tube, an engine head attached to the first diaphragm of the liquid piston, wherein the engine head and the diaphragm define a variable volume combustion chamber, wherein the engine head defines an opening so that a compressed air-fuel mixture of at least 20 psig may pass therethrough, an ignition device attached to the engine head in order to combust the air-fuel mixture in the combustion chamber, an exhaust valve attached to the engine head so that combustion byproducts pass through the engine head when the exhaust valve opens, a variable volume compression chamber, the compression chamber further including a housing attached to the second solid piston of the liquid piston, opposite the second transition member, an inlet valve attached to the housing, an outlet valve attached to the housing, a reservoir, the reservoir further including a first tube attached to the variable volume compression chamber, a reservoir body attached to the first tube, wherein the reservoir body is pressurized to at least 20 psig by the compression chamber, a second tube attached to the reservoir body so that pressurized air is released for use, a third tube attached to the reservoir body so that pressurized air is released to an air/fuel mixing circuit, an air/fuel mixing circuit attached to the third tube, and an air/fuel line attached to the mixing circuit in order to provide air/fuel for combustion in the combustion chamber.

Accordingly, one provision of the invention is to provide an engine-compressor for use with periods of inactivity.

Still another provision of the invention is to provide a liquid piston engine-compressor that is light weight and portable.

Yet another provision of the invention is to provide a power generation system that is for use with mobile or portable devices which need a portable long lasting energy source.

DETAILED DESCRIPTION OF THE INVENTION

Figure 1:
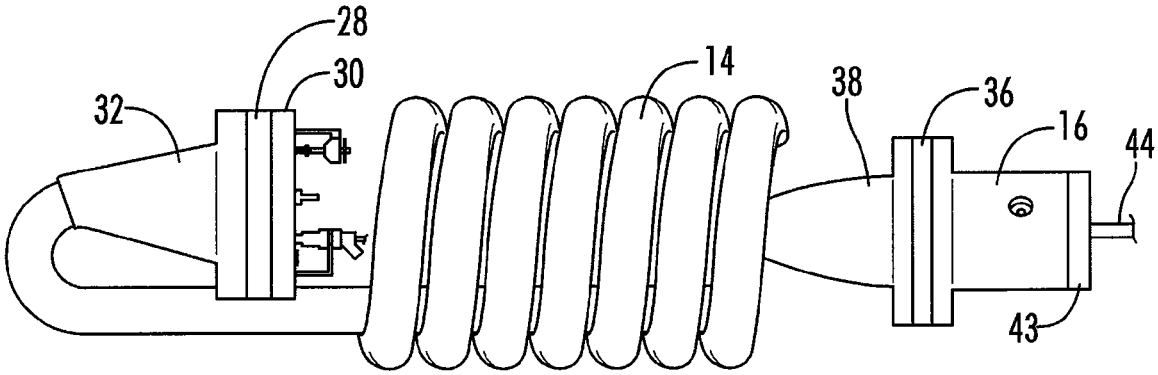
FIG. 1 shows a side view of an embodiment of the engine head, liquid piston, and compression chamber. Shown therein is a coiled configuration of the liquid piston for efficient packing in a limited space.

The present invention discloses an engine-compressor device 10 that is self sufficient in the generation of compressed air for long periods of time. Such a device is for use with other devices making use of compressed air, such as air powered tools, or the like. The present invention is a self-contained and untethered, device 10 for the use of an air-fuel mixture in combustion for the generation of compressed air for use by another device. In certain embodiments of the present invention, the engine-compressor device 10 includes an engine head 30, a liquid piston 14, a compression chamber housing 16, a reservoir 46 for the compressed air which is generated, microcontroller 100, a mixing circuit 50 for the mixing of air and fuel, and an outlet tube 56 for delivery of the compressed air to a pneumatically actuated device. At least a part of the novelty of the device 10 is the use of a flexible diaphragm 28 in combination with a liquid piston 14 to achieve a high-inertance and the operational features it affords, as further described herein. The device 10 described herein solves the problems of limited pneumatic power supply, inability to operate after lengthy nonoperational periods, bulky starter systems, vibration, and temperature issues associated with small-scale engines.

The present invention discloses a free piston compressor having a liquid piston 14 trapped by two elastic diaphragms 28 and 36. An engine head 30, securing an air/fuel injector 20, exhaust valve 24, and a spark plug 22 is mounted against the first diaphragm 28 of one piston end. The second diaphragm 36, at other end of the piston, also seals the cavity of the compression chamber 41, which compresses and pumps air into a reservoir 46 through a check valve 42 during the power stroke, and intakes fresh air through an air intake check valve 40 during the return stroke. In use, the air/fuel injector 20 is opened, injecting a high-pressure mix of a fuel, such as, for example, propane, and compressed air from the reservoir 46, causing the first diaphragm 28, and second diaphragm 36 through communication with the fluid 34, to begin to expand. This injection pressure is resisted by the inertial forces of the liquid piston 14. Injection is stopped and the spark plug 22 fires, combusting the air/fuel causing a rapid pressure increase. This driving pressure begins to expand both piston diaphragms 28 and 36 (since the fluid 34 of the piston 14 is effectively incompressible), setting the piston 14 into rapid motion. The expansion of the second diaphragm 36 decreases the volume of the compression chamber 41, thereby compressing trapped air until the pressure rises above the pressure of the reservoir 46, at which time the air is pumped through the check valve 42 into the reservoir 46. When full pumping of the compressed air has occurred and the motion of the liquid piston stops, the combustion exhaust valve 24 on the combustion side is opened by energizing a solenoid 26, releasing combustion products through the opening 23 and eliminating the driving pressure, thus allowing the stiffness of the stretched diaphragms 28 and 36 to return the liquid piston 14 and both diaphragms to their initial positions. During this return, fresh air enters the compressor chamber 41 through the inlet check valve, also called the air intake 40. Once the piston 14 has returned to its original position, the exhaust valve 24 is closed and another cycle can begin.

Free-Piston Engines as Power Supplies

Despite free piston devices having been studied in the past, none of these previous designs explicitly featured what is perhaps the main advantage of a free piston, which is its capability to offer a dominantly inertial load. Previous research fails to explicitly exploit this feature through design. The present invention exploits through design the fact that a free piston can present an inertial load to the combustion pressure, and as a result, desirable operational characteristics can be obtained, such as high efficiency, low noise, and low temperature operation. The fundamental research barrier preventing this is a lack of tools regarding the design of "dynamic engines". What is needed is a model-based design approach that combines the system dynamics and thermodynamics that are more intimately coupled in a free piston engine than a traditional kinematic engine. Discussed herein in is: 1) the dynamic analysis of such engines in light of exploiting the intermediate kinetic energy storage of the free piston, and 2)

a synthesis method for the design of free-piston engine devices that have a load tailored for certain applications, such as pumping hydraulic fluid, compressing air, and other outputs, while also being "shaped" to benefit the combustion cycle for efficiency, power density, control and/or other metrics. Accordingly, the present invention demonstrates that a free piston compressor may be a portable power supply system for untethered human-scale pneumatic robots.

Riofrio, et al. designed a free piston compressor specifically for a lightweight untethered air supply for actuation of traditional pneumatic cylinders and valves, using hydrocarbon fuels as an energy source. Riofrio, J. A., and Barth, E. J., "A Free Piston Compressor as a Pneumatic Mobile Robot Power Supply: Design, Characterization and Experimental Operation". *International Journal of Fluid Power,* 8(1), February 2007, pp. 17-28. The piston, acting as an inertial load, converts the thermal energy on the combustion side of the engine into kinetic energy, which in turn compresses air into a reservoir to be used for a pneumatic actuation system.

A second device by Riofrio et al., a free liquid-piston compressor (FLPC), was designed using a liquid trapped between elastomeric diaphragms as a piston. Riofrio, J. A., and Barth, E. J., 2007b. "Design and Analysis of a resonating Free Liquid-Piston Engine Compressor". 2007 *ASME International Mechanical Engineering Congress and Exposition* (*IMECE*), IMECE2007-42369, November 2007. The liquid piston eliminated the blow-by and friction losses of standard piston configurations. This device incorporated a combustion chamber that was separated from an expansion chamber. Once the high pressure combustion gasses were vented into the expansion chamber, PV work was converted to inertial kinetic energy of the piston. The separated combustion chamber kept air/fuel injection pressure high prior to ignition for efficient combustion, and allowed for air/fuel injection that was decoupled from power and return strokes of the engine cycle. The separated combustion chamber and the high pressure injection of both air and fuel allowed for an engine devoid of intake and compression strokes. Achievements included: 1) Experimentally validated dynamic model of the pressure dynamics due to combustion, combustion valve inertial dynamics, expansion chamber pressure dynamics, compressor chamber pressure dynamics, reservoir pressure dynamics, 2) Experimental characterization of prototype I efficiency (2.03% overall efficiency from chemical potential to stored pneumatic potential energy in the reservoir—the target metric is 3.25%) and power (52 watts—the target metric is 100 watts), 3) A design-based diagnosis of prototype I led to a number of quantified design tradeoffs and conclusions for subsequent designs, 4) Prototype II (FLPC) was designed, has a much smaller footprint than prototype I, and incorporates design changes to overcome the inadequacies of prototype I, 5) A full dynamic simulation of prototype II was used in its design to size and scale with respect to design tradeoffs between desirable effects and losses, 6) A "virtual dynamic cam" framework is being developed as a generalized method for the control of free-piston and dynamically dominant engines without a kinematic index (crankshaft).

The present free liquid piston compressor exploits the geometry of the liquid piston to create a high inertance, which advantageously slows the dynamics of the system without the penalty of adding more mass. Modeling and simulation of the high inertance free liquid piston is briefly presented here, and implications on the performance of a free-piston engine compressor utilizing this liquid piston are discussed.

Liquid Piston Inertance

Figure 5:
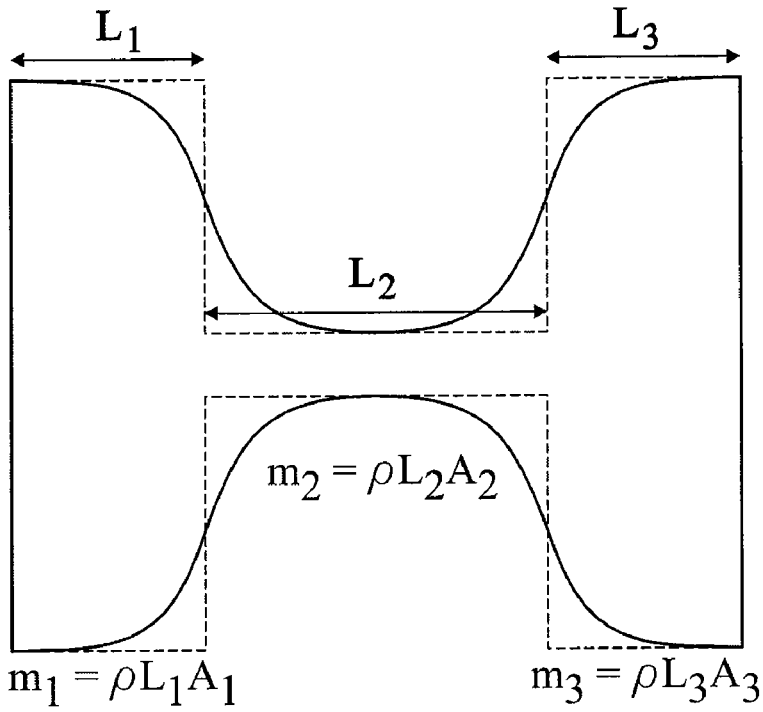
FIG. 5 is a schematic diagram showing the three regions of a generic high inertance liquid piston.

By way of background, a fluid filled pipe approximated with three regions of effective lengths $L_1$, $L_2$, and $L_3$, with distinct cross sectional areas and liquid masses as shown in FIG. 5. This configuration represents the liquid chamber between two moving seals, such as solid pistons or elastomeric diaphragms. An external force acting on either of the moving seals will cause fluid flow through the chamber.

The power flowing through the fluid filled pipe of FIG. 5, in response to the left and right boundaries moving, can be represented as the time derivative of the kinetic energies in each of the flow regions:

$$PQ = \frac{d}{dt}\left[\frac{1}{2}m_1\left(\frac{Q}{A_1}\right)^2 + \frac{1}{2}m_2\left(\frac{Q}{A_2}\right)^2 + \frac{1}{2}m_3\left(\frac{Q}{A_3}\right)^2\right] \tag{1}$$

where P is the pressure difference across the left and right moving boundaries, and Q is the volumetric flow rate of the piston fluid. Substituting $m_i=\rho L_i A_i$ for the masses of liquid in each flow region, differentiating, substituting $\dot{L}_1=-Q/A_1$, $\dot{L}_2=0$ and $\dot{L}_3=Q/A_3$, and solving for pressure, we obtain Eq. 2:

$$P = \left[\frac{\rho L_1}{A_1} + \frac{\rho L_2}{A_2} + \frac{\rho L_3}{A_3}\right]\dot{Q} + \frac{\rho}{2}\left[\frac{1}{A_3^2} - \frac{1}{A_1^2}\right]Q^2 = I\dot{Q} + A_c Q^2 \tag{2}$$

It follows that the relationship between pressure and flow rate of Eq. 2 consists of the steady-state term due to the area changes between regions, and the dynamic term relating P and $\dot{Q}$ through the inertance of the fluid slug. The inertance, I, of the liquid piston is therefore:

$$I = \left[\frac{\rho L_1}{A_1} + \frac{\rho L_2}{A_2} + \frac{\rho L_3}{A_3}\right] \tag{3}$$

It can be seen that the second region of this configuration, termed the high inertance (HI) section, can be given a large length to area ratio $L_2/A_2$ to dominate the inertance in Eq. 2. Thus, the fluid's dynamics can be made slower through piston geometry rather than by the mass of the liquid alone.

Design Implications of Slower Piston Dynamics

The FLPC described by Riofrio, et al (2007b), showed the viability of using a free piston compressor for use as a portable pneumatic power source for human scale robotics. The design of the FLPC does, however, have some issues that lead to either compromised performance or compromised efficiency for a compact device. The high inertance free liquid piston 14 described herein, within the context of being incorporated into an engine-compressor (HI-FLPC) enables three important features. These features are: 1) a better design tradeoff for valve sizing that reduces valve losses, 2) fire-on-demand capability within the same chamber as one of the liquid piston's diaphragms, and 3) a balanced or nearly balanced engine with a single (liquid) piston.

Valve Sizing. In a free-piston engine compressor, the check valve responsible for pump flow between the pump chamber and the reservoir has to be large enough to prevent a pressure rise in the pump chamber appreciably above the reservoir pressure (valve needs a large flow area), yet fast enough to prevent a backflow from the reservoir to the pump chamber once the pressure difference reverses at the end of the stroke (valve needs to close quickly). The speed of the piston will require a certain mass flow rate, which can be achieved by either 1) a large flow orifice area and a small pressure difference across the valve, or 2) a small orifice area and a large pressure difference. The extreme of case 1 will cause a backflow through the valve due to the fact that a larger passive valve is slower to close. The extreme of case 2 will cause the piston to bounce against the pressure in the pump chamber before full pumping occurs. A solution that reduces the severity of this tradeoff is to reduce the required mass flow rate by slowing the overall piston motion while maintaining the same piston kinetic energy. Incorporating a liquid piston with high inertance addresses this issue by achieving slower dynamics without the mass penalty of more fluid, which will allow for a smaller pump check valve, and thus a more compact and lighter weight device.

Fire-on-Demand. A piston with dynamics slow enough could allow air/fuel injection and ignition to occur before significant piston motion. This would allow a high pre-combustion pressure (equivalent to a high compression ratio in traditional 4 stroke engines). Partly for this reason, the high-inertance load and slower dynamics of the liquid piston 14 allows a fire-on-demand (no idle) operation. The other contributor to the fire-on-demand operation is the fact that high pressure air is available from the device for mixing with a high pressure fuel such that a mixture of both may injected under pressure to avoid the conventional intake and compression strokes performing the same combined function in a conventional 4-stroke engine. For such fire-on-demand operation, the injection of the air/fuel mixture needs to occur within a timeframe that does not appreciably move the piston 14. With the inertance values achievable with the invention described herein, it is possible to reduce this timeframe to where commercially available fuel injectors, adapted to inject a pre-mixed air/fuel mixture, are fast enough to inject the desired amount of such mixture within such a timeframe. The high inertance of the liquid piston arrangement 28, 32, 14, 38 and 36 presents dynamics forces to resist the injection pressure for a period of time that is sufficient for the injector to inject the correct amount of air/fuel mixture while maintaining a high pre-combustion pressure.

Engine Balance. The long, small-diameter inertance section of the piston 14 can be configured such that the first diaphragm 28 and the second diaphragm 36 oppose each other, giving the device 10 a more balanced operation. Coiling of the inertance tube 15 around the compression chamber housing 16 will also help retain a compact design, although care must be taken not to add significant pressure losses due to the configuration of the inertance section of the piston 14.

Dynamic Model of the Present Invention

The present invention will utilize Eq. 2 as the foundation of the piston model in the free-piston engine compressor 10. This liquid piston model then replaces the (low inertance) piston model of the overall FLPC validated system model. The inertial and steady-flow components can be summarized as $$\Delta P = I\dot{Q} + A_c Q^2 \tag{4}$$

This expression will be augmented by adding viscous losses of the fluid flow, particularly in the inertance tube 15 (region 2). Stiffness of the elastomeric diaphragms 28 and 36 will also be included.

Viscous Losses in the Fluid. The inertance achieved by the large $$\frac{L_2}{A_2}$$

ratio will come at a price, namely, viscous losses of the fluid flow through the piston. This viscous loss, represented in Eq. 5 by R, relates pressure drop to volumetric flow rate:

$$\Delta P = I\dot{Q} + A_c Q^2 + RQ \tag{5}$$

A preliminary simulation of a liquid piston was conducted to investigate the magnitude of viscous losses. Equation (5) was implemented in MATLAB, with the resistance term of Eq. (6) derived from the Darcy-Weisbach equation:

$$R = \frac{8\rho}{\pi^2 d_2^4} Q \cdot f \frac{L_2}{d_2} \tag{6}$$

Where ρ is the density of the fluid (water), and $L_2$ and $d_2$ are the diameter and length of the high inertance tube, respectively. The friction factor $f$ was taken from the Moody Chart to be 0.025, based on drawn tubing and a conservative Reynolds number calculated at the average velocity of fluid in the tube for a 40 millisecond pump stroke obtained from a dynamic simulation without losses for our scale of interest. This conservative calculation for $f$ will help offset possible additional pressure losses associated with the oscillatory nature of the piston flow, which is not accounted for in the model. Given the chosen area ratios between region 2 to region 3 of the liquid piston, pressure losses due to the expansion of flow (Carnot-Borda losses) were estimated to be less than 5 kPa at simulated fluid velocities, and were therefore neglected.

Other physical piston parameters can be chosen appropriately for the size and power range of the present invention. Most critically, the high inertance tube 15 of the piston 14 was modeled as 147.3 cm long ($L_2$) with a cross-sectional area $A_2$ of 1.98 cm. The initial pressure differential acting on the piston was taken to be $2.05\times10^6$ Pa, similar to pressures achieved from combustion in the FLPC. The pressure-volume profile was similar to that seen in the FLPC. If stiffness effects of the diaphragms are ignored, the average fluid velocity will be artificially high and therefore the viscous drag will be an upper bound.

Figure 6:
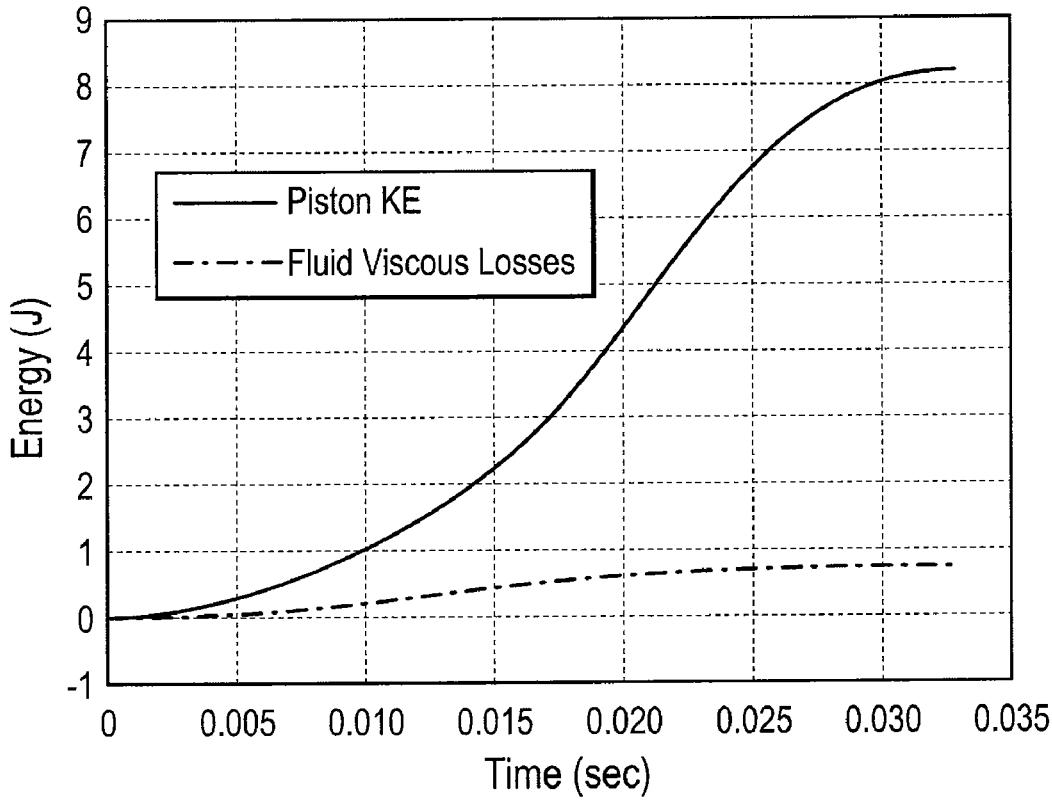
FIG. 6 is a graph showing the simulation of viscous losses relative to piston kinetic energy.

FIG. 6 shows results for this simulation. The total kinetic energy of the piston is seen to be more than one order of magnitude greater than the losses due to viscous effects. It is concluded that for the length and cross-sectional area used for the inertance tube 15 in this simulation viscous losses are not significant in relation to the kinetic energy carried by the piston 14.

Liquid Piston Diaphragm Stiffness. The liquid piston 14 of the present invention is contained (and allowed to move) by two elastomeric diaphragms 28 and 36, an example of which is shown in FIG. 2. These diaphragms 28 and 36 are considered in the dynamic model of the piston 14 to be pure springs—mass and damping characteristics are being captured by the inertance and viscous loss lumped parameter terms. The total stiffness of the diaphragms 28 and 36 is represented by the $K_{tot}$ term in Equation (7), the dynamic equation for the inertance-type liquid piston as derived by Willhite, J. Willhite, J. A.; Barth, E. J., Reducing piston mass in a free engine compressor by exploiting the inertance of a liquid piston. 2009 *ASME Dynamic Systems and Control Conference & Bath/ASME Symposium on Fluid Power and Motion Control*. DSCC2009-2730, pp. 1-6, October 2009. This term relates differential pressure across the piston as a function of volume displaced by diaphragm stretching, and can be isolated and measured in steady-state as shown in Equation (8).

$$\Delta P = I\dot{Q} + A_c Q^2 + RQ + K_{tot}\Delta V \tag{7}$$

$$\Delta P_{SS} = K_{tot}\Delta V_{SS}, \text{ where } K_{tot} = f(\Delta V_{SS}) \text{ and } \Delta V_{SS} \int Q dt \tag{8}$$

For efficient transduction of energy from combustion to the compression chamber 41, this stiffness should be small so that it does not store much of the combustion energy. However, some energy storage is necessary for the return stroke. Since there is no "bounce chamber" effect of the gas when full pumping is achieved, the energy stored in the diaphragms 28 and 36 is the only driver of the return stroke. The value of $K_{tot}$ becomes critical in optimizing overall power output of the compressor by determining how the combustion energy is divided between pump stroke and return stroke. For example, a higher value for $K_{tot}$ gives a faster return stroke and therefore higher operating frequency, but less pumping energy per stroke, while a lower $K_{tot}$ yields more pumping energy but slower return (lower frequency).

Figure 7:
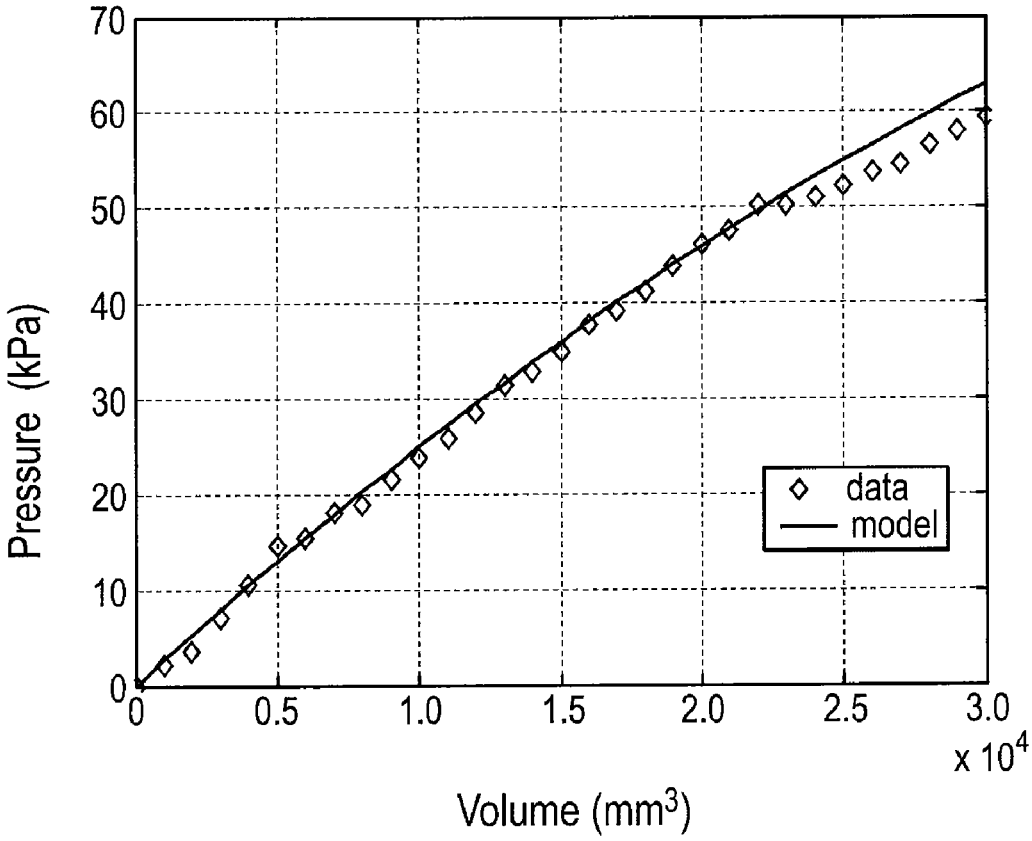
FIG. 7 is a graph showing the steady-state volume displaced by the diaphragm for given pressure differentials and the least squares fit.

Diaphragms 28 and 36 with a displacement cross sectional radius of 25.4 mm and being 16 mm thick were tested to characterize the stiffness. FIG. 7 shows measured volume displacements for different driving pressures across the diaphragm. An exponential least squares fit yields the curve:

$$\Delta P_{SS}=K_{tot}\Delta V_{SS}, \text{ where } K_{tot}=-2\times10^{-8}\Delta V_{SS}+2.7\times10^{-3}$$

With the energy storage of the piston characterized, the proper mass investment of air/fuel can be determined to compress and pump the entire charge of air in the compression chamber 41. Modelling of the return stroke will then indicate if this diaphragm stiffness is optimized for frequency and power output. If needed, the stiffness can be adjusted by varying the thickness and/or durometer of the diaphragms 28 and 36.

Simulation Studies

A computer simulation of the present invention was carried out. Control volumes for the combustion chamber 12 and compression chamber 41 were modeled, with the high inertance liquid piston 14 dynamics coupling their behavior. A control volume representing the reservoir 46 was also incorporated. Valve dynamics and mass flows for the air/fuel intake and exhaust valves of the combustion chamber 12 were modeled, as well as the breathe-in and pump valve for the compression chamber 41.

The dynamic model presented by Yong, et al., is referred to here for understanding modeled components other than the piston dynamics, including combustion rate dynamics. C. Yong, J. A. Riofrio and E. J. Barth. "Modeling and Control of a Free-Liquid-Piston Engine Compressor," *Bath/ASME Symposium on Fluid Power and Motion Control* (FPMC 2008), pp. 245-257, September 2008. The following represents the power balance for each $j^{th}$ control volume (specifically, the combustion chamber, the pump chamber, and the reservoir):

$$\dot{U}_j=\dot{H}_j+\dot{Q}_j-\dot{W}_j \tag{9}$$

where $\dot{U}$ is the rate of change of internal energy, $\dot{H}$ is the net enthalpy flowing into the CV, $\dot{Q}$ is the rate of heat transfer into the CV and $\dot{W}$ is the work rate of the gas in the control volume. Each term in Eq. (9) can be expanded as follows:

$$\dot{H}_j=\sum_k \dot{m}_{j,k}(c_{p_{in/out}})_{j,k}(T_{in/out})_{j,k} \tag{10}$$

$$\dot{W}_j=P_j\dot{V}_j \tag{11}$$

and $$\dot{U}_j=\dot{m}_j(c_v)_jT_j+m_j(c_v)_j\dot{T}_j=\frac{1}{\gamma_j-1}(\dot{P}_jV_j+P_j\dot{V}_j) \tag{12}$$

where $\dot{m}$ is the $k^{th}$ mass flow rate entering or leaving each $j^{th}$ CV with constant-pressure specific heat $c_{Pin/out}$ and temperature $T_{in/out}$, P and V are the pressure and volume in the CV, $c_v$ is the constant volume specific heat and $\gamma$ is the ratio of specific heats of the gas in the CV. Equations (10-12) can be used to form the following differential equations:

$$\dot{P}_j=\frac{(\gamma_j-1)\sum\dot{m}_j(c_{p_{in/out}})_j(T_{in/out})_j+(\gamma_j-1)\dot{Q}_j-\gamma_jP_j\dot{V}_j}{V_j} \tag{13}$$

$$\dot{T}_j=\frac{\sum\dot{m}_j\left[(c_{p_{in/out}})_j(T_{in/out})_j-(c_v)_jT_j\right]-P_j\dot{V}_j+\dot{Q}_j}{m_j(c_v)_j} \tag{14}$$

The mass flow rates $\dot{m}_j$ for the valves are determined by the following equation (Richer, E., and Hurmuzlu, Y., "A High Performance Pneumatic Force Actuator System: Part 1—Nonlinear Mathematical Model". *ASME Journal of Dynamic Systems, Measurement and Control,* 122, September, 2000, pp. 416-425):

$$\dot{m}_j=\psi_j(P_u,P_d) \tag{15}$$

$$=\begin{cases} C_da_jC_1\dfrac{P_u}{\sqrt{T_u}} & \text{if } \dfrac{P_d}{P_u}\le P_{cr} \\ C_da_jC_2\dfrac{P_u}{\sqrt{T_u}}\left(\dfrac{P_d}{P_u}\right)^{1/\gamma_u}\sqrt{1-\left(\dfrac{P_d}{P_u}\right)^{\gamma_u-1/\gamma_u}} & \text{if } \dfrac{P_d}{P_u}>P_{cr}\end{cases}$$

where $C_d$ is a non-dimensional discharge coefficient of the valve, $a_j$ is the area of the valve orifice, $P_u$ and $P_d$ are the upstream and downstream pressures, $T_u$ is the upstream temperature, $\gamma_u$ is the ratio of specific heats in the upstream gas, and $C_1$, $C_2$, and $P_{cr}$ are determined by:

$$C_1=\sqrt{\frac{\gamma_u}{R_u}\left(\frac{2}{\gamma_u+1}\right)^{\gamma_u+1/\gamma_u-1}},\ C_2=\sqrt{\frac{2\gamma_u}{R_u(\gamma_u-1)}}, \tag{16}$$

and $$P_{cr}=\left(\frac{2}{\gamma_u+1}\right)^{\gamma_u/\gamma_u-1}$$

where $R_u$ is the gas constant of the upstream substance.

A model of the combustion process and its influence on the pressure and temperature in the combustion chamber was taken from Yong et al. 2008. All valve operation dynamics influencing each $a_j$ were modeled as second order and tuned by experimental data from the FLPC.

Two simulation models were compared to illustrate the effect of the high inertance liquid piston. The first model, representing the HI-FLPC, incorporated a high inertance piston design with an inertance tube 15 length ($L_2$) of 1.473 m, and a cross-sectional area $A_2$ of 1.98 $cm^2$. A second simulation with no cross-sectional area change in the liquid piston 14 was examined. All parameters excluding piston geometry and piston mass for the two models were kept the same.

Figure 8:
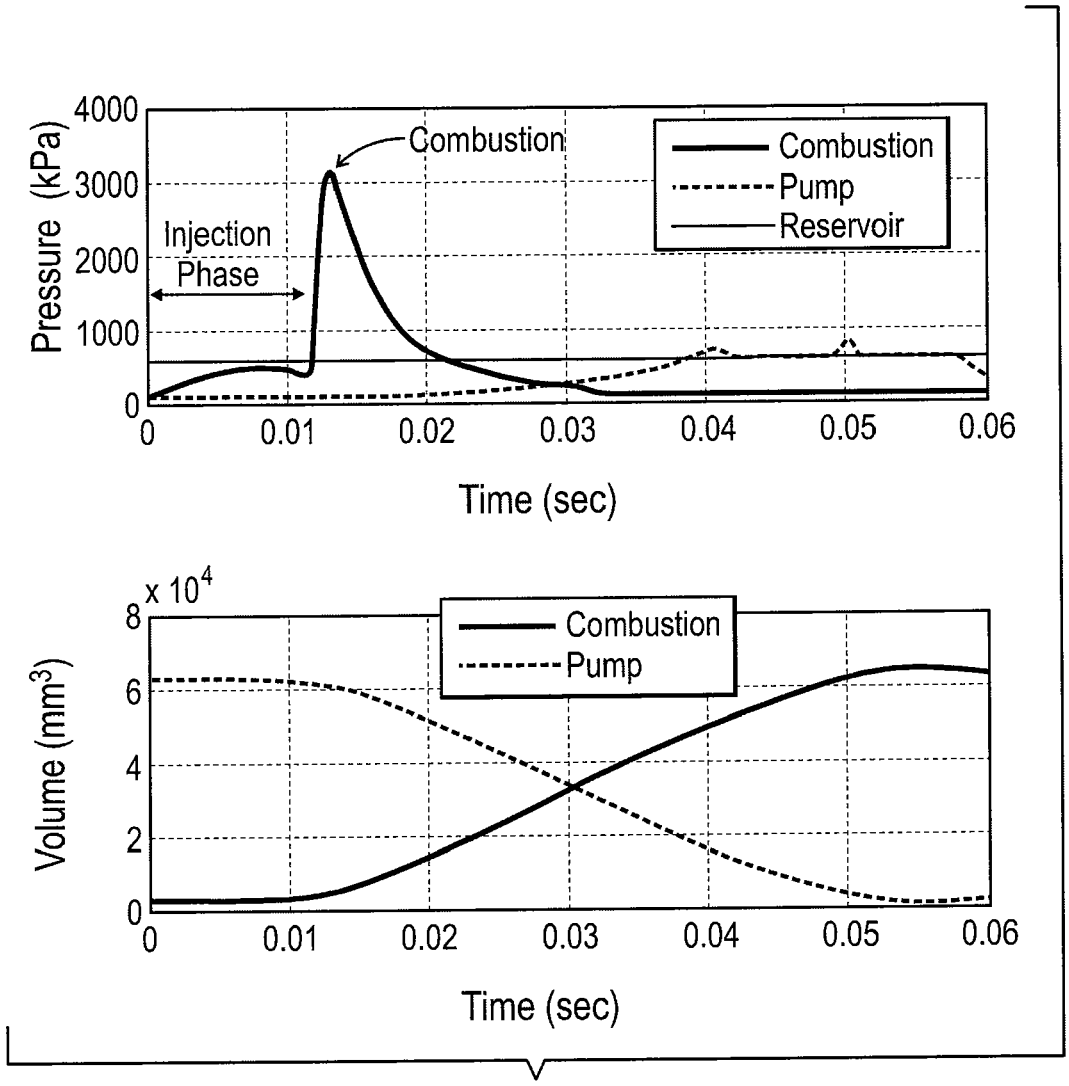
FIG. 8 shows pressures and volumes for a simulation of an embodiment of the present invention with a liquid piston mass of 0.414 kg.

FIG. 8 shows simulation results for the pressures and volumes in the combustion chamber 12, compression chamber 41, and reservoir 46 for the injection, combustion, and pump phases. Note that pumping begins at approximately 40 msec when compression chamber 41 pressure rises above reservoir 46 pressure (about 25 msec after combustion). The reservoir 46 pressure increases by approximately 20 kPa but is not visible on the scale of the figure.

Figure 9:
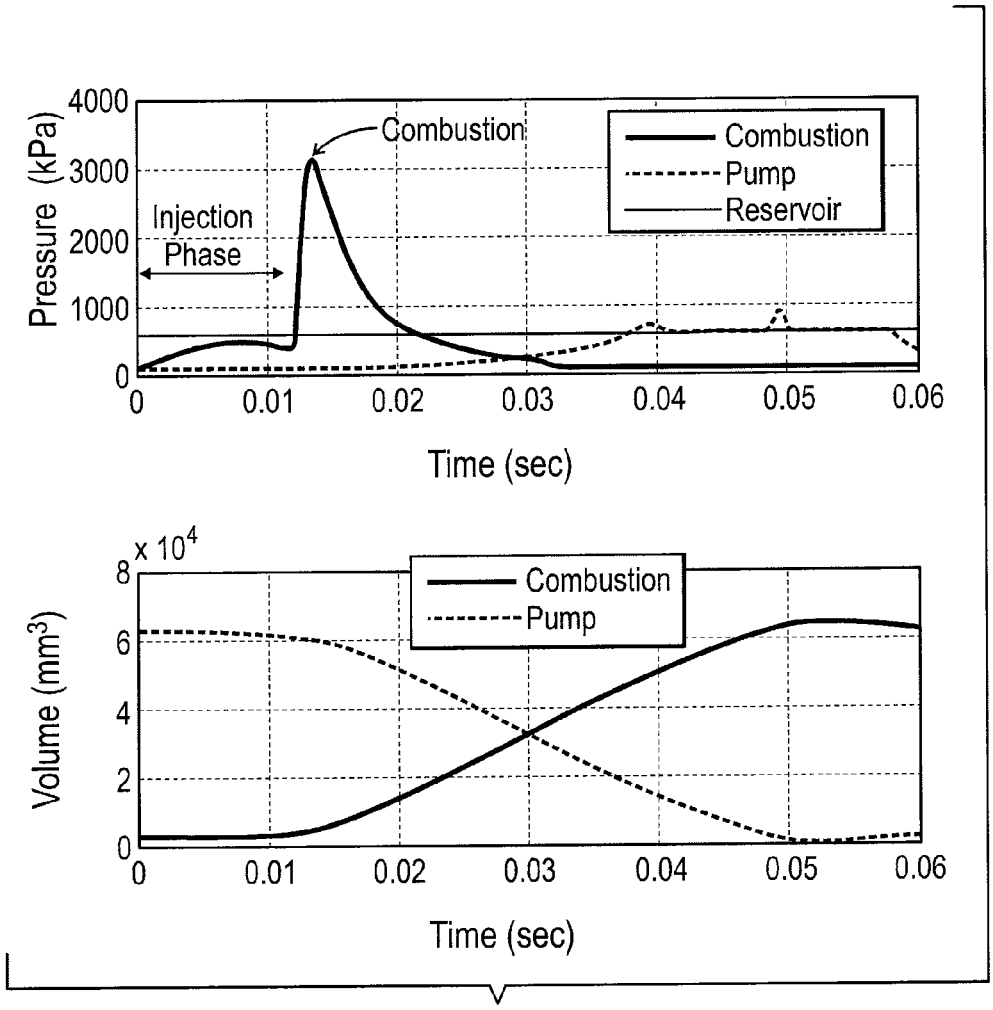
FIG. 9 shows pressures and volumes for a high mass, low inertance, constant cross sectional area liquid piston simulation with a liquid piston mass of 12.5 kg in order to illustrate the weight saving advantages of the high-inertance liquid piston configuration over one of low inertance, or equivalently illustrating weight saving advantages over one of solid piston construction with a mass of 12.5 kg wholly lacking a liquid piston.

FIG. 9 shows simulation results for the simulation with no cross-sectional area change, where the piston mass was adjusted to achieve the same cycle time as the HI-FLPC. The piston mass required to achieve this similar behavior was 12.5 kg of fluid. This represents a mass 30 times that of the HI-FLPC piston mass of 0.414 kg.

Another point of interest in the simulation is the injection phase (occurring between 0 and 11 msec in FIG. 8). Given an air/fuel valve orifice area of 1.54 $mm^2$, which is based on one possible valve appropriate for implementation, injection pressure of air/fuel in the combustion chamber 12 pressure is dynamically "held" by the piston long enough for good combustion, supporting the idea that the HI-FLPC does not require a separated combustion chamber.

In summary, a dynamic model of a high inertance free liquid piston was developed and presented herein. Previous work on a free-piston engine compressor revealed certain complications associated with the fast dynamics of the piston motion. Following from this motivation, the concept of inertance was exploited to slow the dynamics of the piston motion while concomitantly reducing the mass of the piston. It was shown that a high inertance liquid piston with a mass of 0.414 kg has the equivalent dynamic response of a 12.5 kg liquid piston of uniform cross sectional area. It was also shown that the required "inertance tube" 15 section of the high inertance liquid piston exhibits insignificant viscous losses for the geometries considered. Finally, the dynamic response of the high inertance liquid piston resolves significant issues when incorporated into a free-piston engine compressor device. These issues are: 1) valve sizing, 2) complications associated with a separated combustion chamber, and 3) a balanced engine. The features discussed that resolve these issues are, respectively: 1) a better design tradeoff for valve sizing that reduces valve losses, 2) fire-on-demand capability within the same chamber as one of the liquid piston's diaphragms, and 3) a balanced or nearly balanced engine with a single (liquid) piston.

Figure 2A:
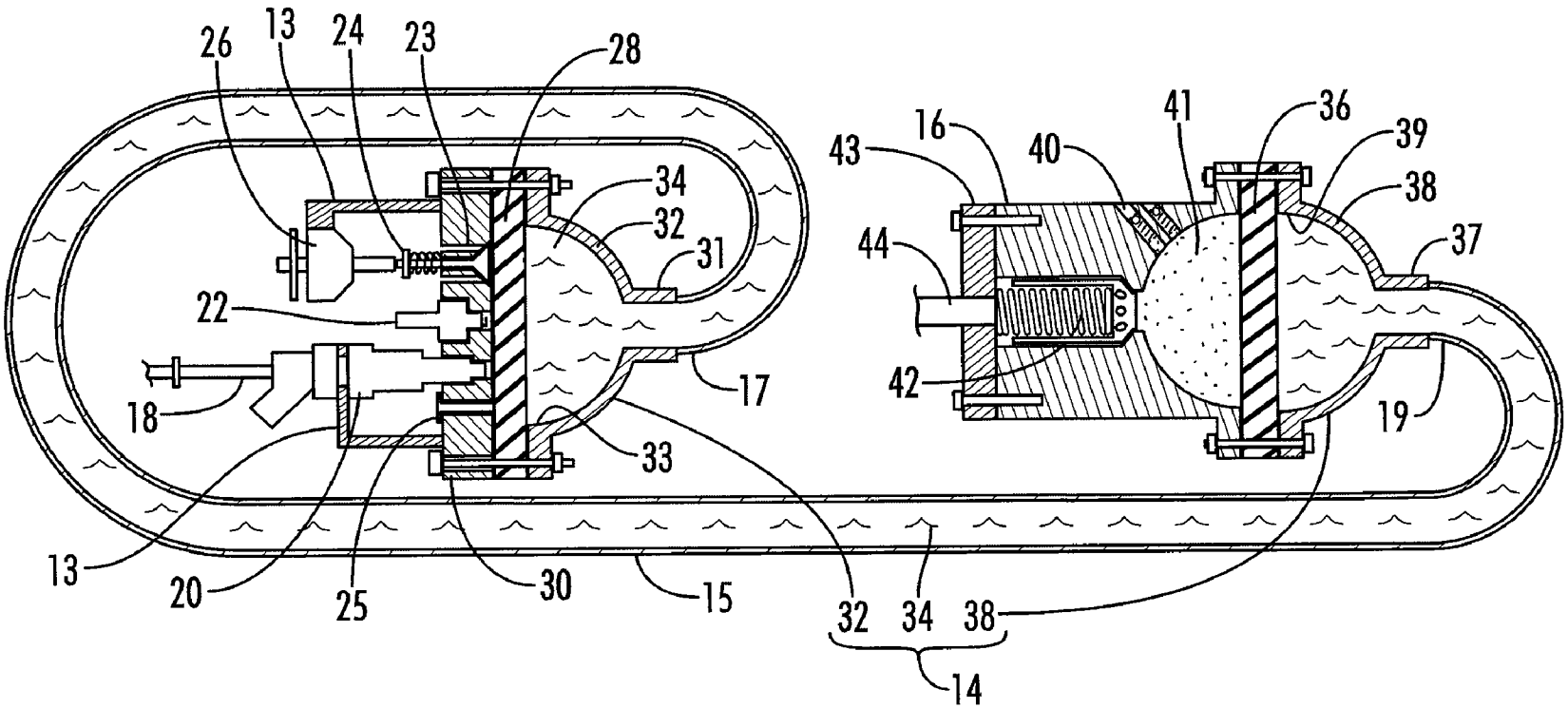
FIG. 2A shows a cross-sectional view prior to combustion of an air/fuel mixture of the engine head, liquid piston, and compression chamber of the present invention.
Figure 2B:
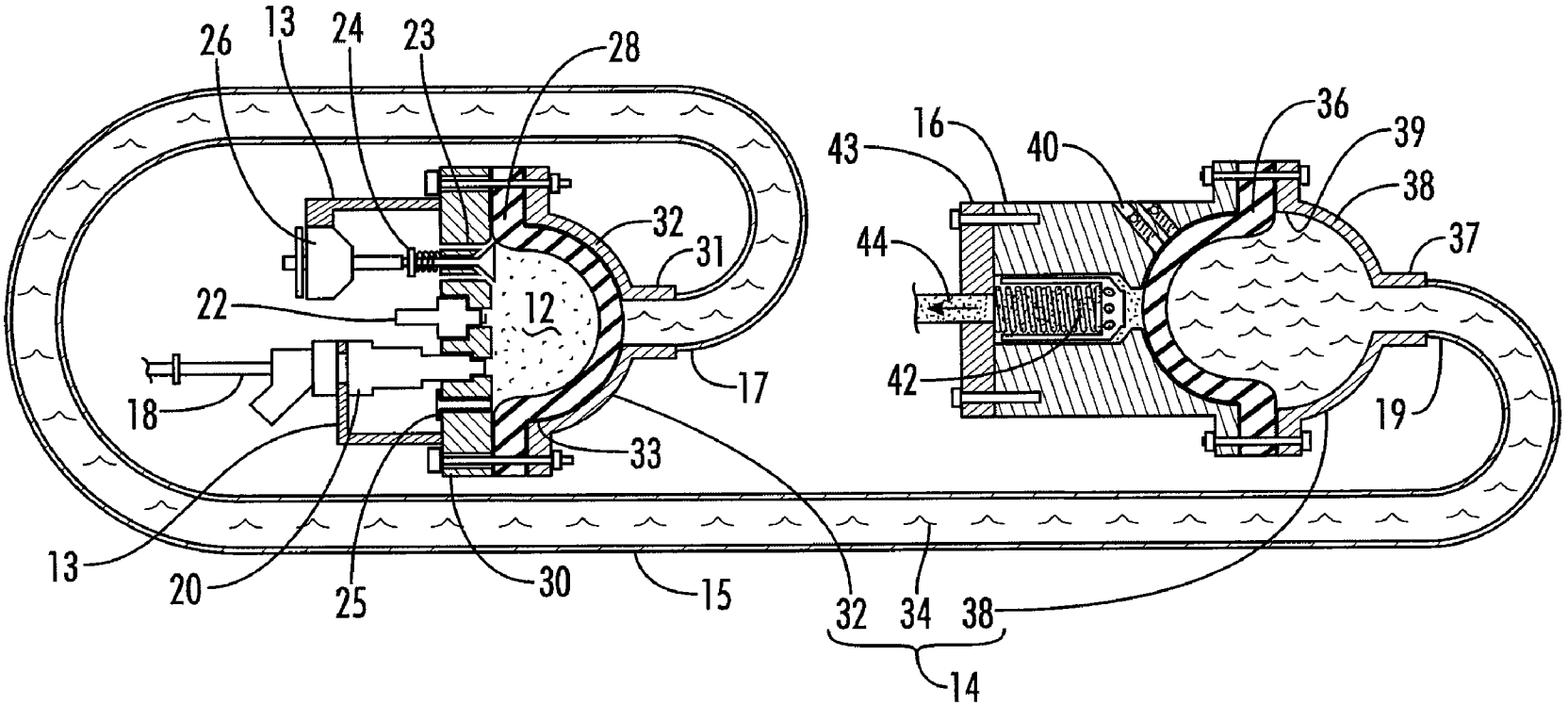
FIG. 2B shows a cross-sectional view after combustion of the air/fuel mixture of the embodiment shown in FIG. 2A. Shown therein is the movement of the first diaphragm in response to the combustion. The movement of the first diaphragm causes the second diaphragm to move and compress the air in the compression chamber. The compressed air is then stored in a reservoir for use by a pneumatically actuated device.
Figure 3:
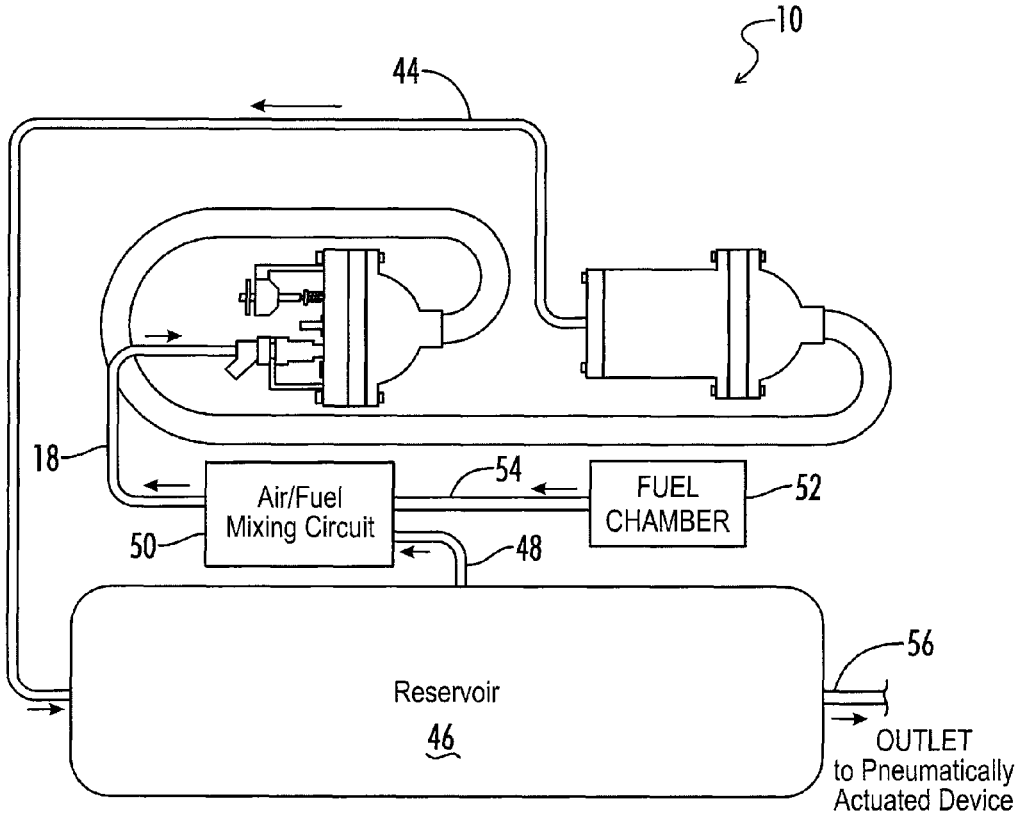
FIG. 3 is a schematic diagram of an embodiment of the present invention. Shown therein is the compressed air reservoir and the connections for receiving the compressed air from the compression chamber, moving compressed air to a pneumatically actuated device and moving compressed air to the pressurized air/fuel mixing circuit.
Figure 4:
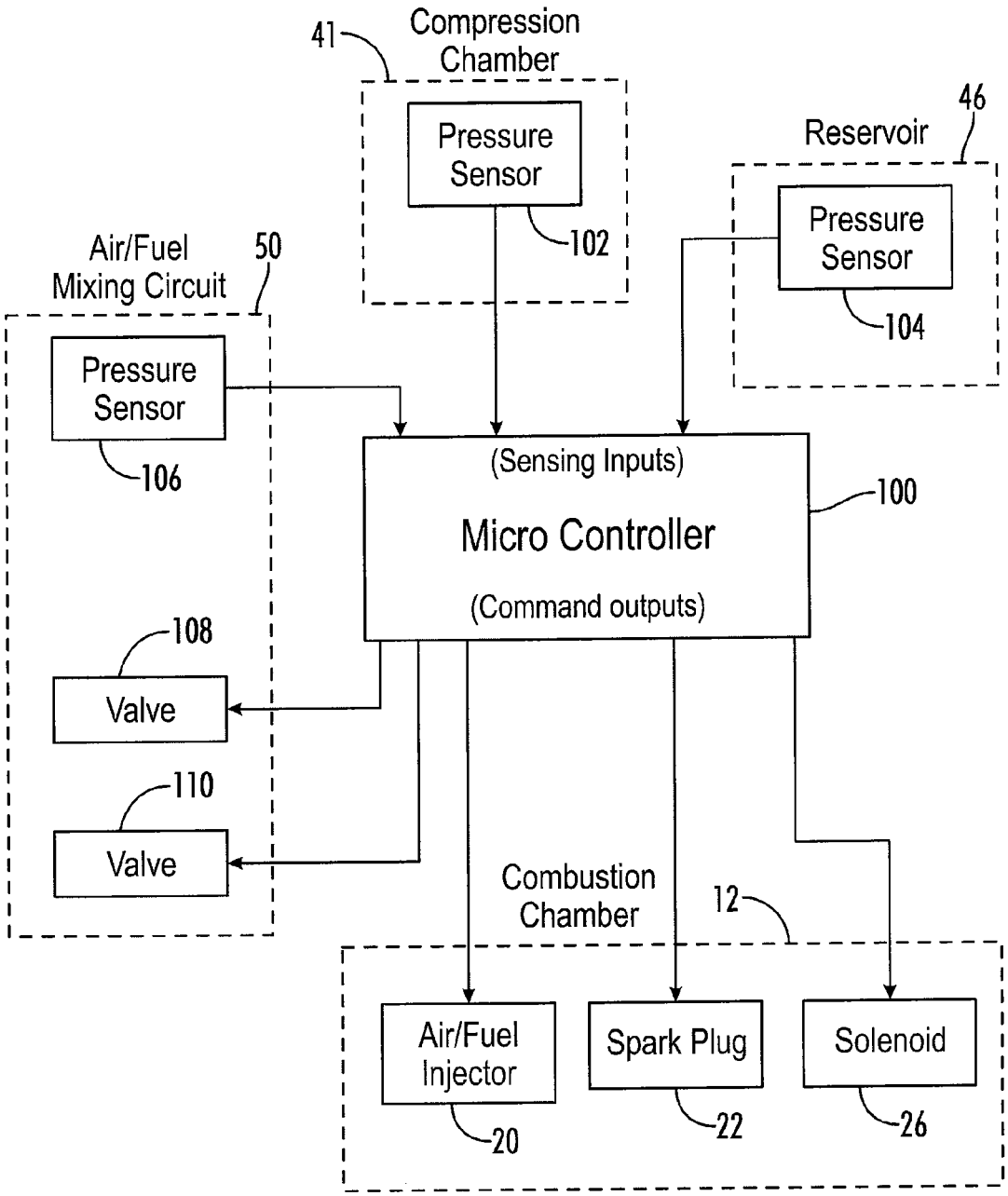
FIG. 4 is a schematic diagram of electronic/data connections of an embodiment of the invention. Shown therein are pressure sensors in communication with a microcontroller so that information is provided to the microcontroller. Also shown are the connections for the command outputs from the microcontroller to the shown actuated valves and spark plug.

Referring now to FIG. 1, there is shown an embodiment of the present invention. Shown therein is an embodiment of the present invention having an engine head 30, a liquid piston 14 in a coiled configuration, and a compression chamber 16. Additional elements of device 10 as further described below are not shown in this figure. This figure merely shows a coiled embodiment of the liquid piston 14 which results in efficient packing of the lengthy liquid piston 14 in a limited space. The entire device 10 is shown in FIG. 3 and the operation of the device 10 is shown in FIGS. 2A and 2B. Further, a schematic wiring diagram for the device 10 is shown in FIG. 4.

Referring now to FIG. 2A, there is shown a cross-sectional view of an embodiment of the engine head 30, liquid piston 14, and compression chamber housing 16 of the present device 10. In order to operate, the present device 10 uses a mixture of air and fuel for combustion in the combustion chamber 12. FIG. 2A shows an embodiment of the present invention at a point in time before combustion occurs and FIG. 2B shows changes when combustion occurs. In certain embodiments of the present invention, a suitable fuel, for example propane, is stored in the fuel chamber 52. In certain embodiments of the invention, the fuel is in gaseous form. The fuel is transported by way of a tube 54 to a mixing circuit 50 where the fuel is mixed with air under pressure. The pressure is provided by compressed air from the reservoir 46 which travels to the mixing circuit 50 by way of tube 48. An appropriate mixture of air and fuel travels from the mixing circuit 50 through the air/fuel line 18 to an air/fuel injector 20 in preparation for a combustion. The air/fuel injector 20, which is attached to the engine head 30, is controlled by a microcontroller 100 so that it provides a proper amount of air/fuel at the proper time. In certain embodiments, a bracket 13 may be used to attach an item, such as injector 20, or solenoid 26, to the engine head 30. Combustion is ignited by a spark plug 22. Upon combustion, the volume of the combustion chamber 12 expands, as best seen in FIG. 2B. The exhaust valve 24 is closed during combustion. The exhaust valve 24 is an actuated valve which is controlled by solenoid 26. Still referring to FIG. 2B, in response to combustion, the diaphragm moves into the first transition member 32 and presses against the fluid 34 which is present therein and within the liquid piston 14, and the second transition member 38. Accordingly, movement of the fluid 34 results in the second flexible diaphragm 36 receiving pressure and flexing into an air filled cavity of the compression chamber 41. The engine head 30 is a rigid structure to which components, such as the air/fuel injector 20, spark plug 22, exhaust valve 24, and inlet valve 25 are attached. The engine head 30 may be constructed of any appropriate material, such as aluminum, as known to those of ordinary skill in the art. Methods of cutting, shaping and machining metal are well known to those of ordinary skill in the art and such services are widely commercially available.

Still referring to FIGS. 2A and 2B, there is shown an embodiment of the compression chamber 41. That chamber 41 is an air filled cavity, into which the second diaphragm 36 flexibly extends in response to the pressure of the fluid 34 in the liquid piston 14. As the second diaphragm 36 compresses the air in the chamber 41, the check valve 42 allows the compressed air to enter the tube 44 for transport to the reservoir 46. After the second diaphragm 36 has completely flexed and is returning to its original position, the air intake check valve 40 allows ambient air to enter the chamber 41. The valve 40 is a one way valve allowing air to enter and not escape.

Referring now to FIG. 3, the compressed air travels through tube 44 to the reservoir 46. With reference to the movement of the compressed air, the tubes and connections between the various elements of the present device 10 are constructed from suitable materials, which are widely commercially available and well now known to those of ordinary skill in the art. Those of ordinary skill in the art are also familiar with the types of connections and fasteners that are suitable for such a pressurized system. In certain embodiments of the present invention, the reservoir 46 is constructed to handle a volume of compressed air and a pressure which are in relation to the function of that specific embodiment. By way of example, in a certain embodiment of the present invention, the reservoir 46 may hold a volume in the range of from about 0.1 liters to about 10 liters, and be capable of holding pressure of at least 20 psig. The compressed air within the reservoir 46 is then output through either tube 48 or tube 56. If the compressed air is to be used for a pneumatically actuated device which is attached to the present invention, then the compressed air travels through tube 56. In order to maintain the pressurized state of the mixing circuit 50, tube 48 provides compressed air from the reservoir 46 to the mixing circuit 50. Measurement of pressure and maintenance of the same within the different chambers of the present invention are monitored and controlled as further described below, specifically with reference to FIG. 4.

With reference to the combustion of the air/fuel mixture, combustion occurs under a pressure of at least 20 psig. Combustion of the air/fuel mixture occurs in the volume defined by the engine head 30 and the first diaphragm 28. By way of example, in certain embodiments of the present invention, the engine head 30 is constructed of aluminum, or the like. The flexible diaphragm 28 is made of an elastic material suitable for performing the function disclosed herein. In certain embodiments of the invention, the diaphragm 28 may be constructed of an elastomer. In other embodiments of the invention, the diaphragm 28 is constructed of a silicone rubber or other high-temperature elastomeric or polymeric material. In still other embodiments of the invention, the diaphragm 28 may be constructed of metal configured to flex, commonly known to one of ordinary skill in the art as a metal bellows. In the embodiment shown in FIGS. 2A and 2B, fasteners are used to compress and secure the diaphragm 28 between the first transition member 32 and the engine head 30. In alternate embodiments of the present invention, the diaphragm 28 may be attached as known to those of ordinary skill in the art. In a similar fashion, in certain embodiments of the present invention, the second diaphragm 36 is constructed of elastic material the same as diaphragm 28. In alternate embodiments of the present invention, the second diaphragm 36 is an alternate material that is suitably flexible, but not needing to endure the conditions of combustion, as the first diaphragm 28 does. Further, the positioning and fastening of the second diaphragm 36 between the second transition member 38 and the compression chamber 41 is by way of fasteners. In alternate embodiments of the present invention, one of ordinary skill may use other fasteners or the like to properly engage the second diaphragm 36 in its proper position. Referring now to the compression chamber 41, the compression chamber 41 is a cavity in which air is compressed. That cavity is provided by a housing 16 which defines the cavity as well as openings for the placement of an outlet check valve 42 and an inlet check valve 40. For example, the check valve 42 is held in position due to the opening within the housing 16. In certain embodiments of the present invention, the housing 16 has an end 43 attached to it in order to secure the connection between the check valve 42 and the tube 44.

With regard to a compact device, the diaphragms 28 and 36 provide a means to seal a variable volume chamber while concomitantly providing a means to return the variable volume chamber to its original configuration with a spring-like quality afforded by the elastic energy stored in the diaphragm when it is stretched. The use of diaphragms 28 and 36 also minimize "dead volume" known in the art of engines and compressors. The minimization of dead volume contributes to a higher efficiency device both with regard to the engine side and the compressor side. The diaphragms 28 and 36 further enhance efficiency of the device by offering a better design tradeoff between sealing and frictional losses than more common solid sliding pistons.

Referring to FIGS. 1, 2A and 2B, there are shown alternate embodiments of the liquid piston 14 of the present device 10. An embodiment similar to that shown in FIG. 1 may be coiled as known to those of ordinary skill in the art. The tube 15 of the liquid piston 14 may be constructed of various metals or high pressure flexible tubing. The embodiment shown in FIGS. 2A and 2B, also, may be configured as known by one of ordinary skill in the art. The coiling, or various bending orientations of the tube 15 of the liquid piston 14 are for storage efficiency of the length of the tube 15. As shown in the Figures, the liquid piston 14 includes a tube 15 which is filled with fluid 34. The tube 15 having a first end 17 and a second end 19. The first end 17 of the tube 15 attaches to the first end 31 of the first transition member 32 and the second end 33 of the first transition member 32 attaches to the first diaphragm 28. At the other end of the tube 15, the second end 19 of the tube 15 attaches to the first end 37 of the second transition member 38 and the second end 39 of the second transition member 38 attaches to the second diaphragm 36.

Referring now to FIG. 4, there is shown a schematic wiring diagram for an embodiment of the present invention. Shown therein is a microcontroller 100, which is a processor, microprocessor, computer, or the like, which is capable of receiving data and is programmable to output commands as further described herein. Such microcontrollers 100 are readily commercially available and are well known to those of ordinary skill in the art. The programming of software, or the use of other commercially available software which is suitable for programming for the operation of functions disclosed herein, is well known to those of ordinary skill in the art. Data connections are shown within FIG. 4, and such connections are well known to those of skill in the art. Although a power source for the microcontroller 100 is not shown in FIG. 4, a power source, such as a battery, or the like, may be used, as known to those of ordinary skill in the art. As previously described herein, the device 10 includes elements which are pressurized. In order to sense such pressure, and take actions to maintain appropriate pressure, pressure sensors are used to report such information to the microcontroller 100. For example, the compression chamber 16 includes a pressure sensor 102 so that the microcontroller 100 receives data regarding the pressure within the compression chamber 16. Also, the reservoir 46 includes a pressure sensor 104 which is in communication with the microcontroller 100. Also, the mixing circuit 50 includes a sensor 106 in order to measure the air to fuel differential pressure and report that information to the microcontroller 100. Pressure sensors are well known in the art and commonly used by those of ordinary skill in the art. In response to the receipt of such information, the microcontroller 100 outputs commands in order to maintain proper operation of the device 10. Still referring to FIG. 4, the microcontroller 100 provides commands to the exhaust valve solenoid 26, spark plug 22, and air/fuel injector 20 of the combustion chamber 12. Further, the microcontroller 100 provides commands to valve 108 which controls the fuel supply, and valve 110 which controls the air supply, within the mixing circuit 50. Use of a microcontroller 100 to operate valves for various functions is well known to one of ordinary skill in the art. In certain embodiments, additional valves may be used as known to one of ordinary skill in the art in order to achieve the functions described herein, such as, for example, controlling the flow of fuel, air, pressure, and the like. The commands provided by the microcontroller 100 result in the precise function and timing of the function of the air/fuel injector 20, spark plus 22, solenoid 26, and the other parts of the invention which are controlled by the microcontroller 100. Again, one of ordinary skill in the art is readily able to program and use and microcontroller 100 for the types of functions disclosed herein. Various alterations of the wiring diagram shown in FIG. 4 may be developed based on the disclosure provided herein. As the parameters for ignition in the combustion chamber 12 and valves opening in order to most efficiently operate the device 10, the microcontroller 100 may be programmed, or otherwise modified, to complete the functions as desired for the specific compressed air needs of the device that relies upon the present invention. In alternate embodiments of the present invention, the wired communications for operation of the device 10 may be performed by use of wireless technology, as known to those of ordinary skill in the art. Accordingly, for example, the device 10 may be operated by the microcontroller 100 in order to provide sufficient compressed air for use with a handheld air tool, or, in the alternative, for the operation of a small robot which is pneumatically actuated.

All references, publications, and patents disclosed herein are expressly incorporated by reference.

Thus, it is seen that the liquid piston engine-compressor of the present invention readily achieve the ends and advantages mentioned as well as those inherent therein. While certain preferred embodiments of the invention have been illustrated and described for purposes of the present disclosure, numerous changes in the arrangement and construction of parts may be made by those skilled in the art, which changes are encompassed within the scope and spirit of the present invention, as defined by the following claims.

What is claimed is:

1. A liquid piston engine-compressor, comprising:

a liquid piston, the liquid piston further comprising:

a tube having a first end and a second end;

a first transition member attached to the first end of the tube;

a second transition member attached to the second end of the tube;

a first diaphragm attached to the first transition member;

a second diaphragm attached to the second transition member, so that the first diaphragm and the second diaphragm trap a fluid in the tube;

an engine head attached to the first diaphragm of the liquid piston, wherein the engine head and the first diaphragm define a variable volume combustion chamber;

wherein the engine head defines an opening so that a compressed air-fuel mixture of at least 20 psig may pass therethrough;

an ignition device attached to the engine head in order to combust the air-fuel mixture in the combustion chamber;

an exhaust valve attached to the engine head so that combustion byproducts pass through the engine head when the exhaust valve opens;

a variable volume compression chamber, the compression chamber further comprising:

a housing attached to the second diaphragm of the liquid piston, opposite the second transition member;

an inlet valve attached to the housing;

an outlet valve attached to the housing;

a reservoir, the reservoir further comprising:

a first tube attached to the variable volume compression chamber;

a reservoir body attached to the first tube, wherein the reservoir body is pressurized to at least 20 psig by the compression chamber;

a second tube attached to the reservoir body so that pressurized air is released for use;

a third tube attached to the reservoir body so that pressurized air is released to an air/fuel mixing circuit;

the air/fuel mixing circuit attached to the third tube; and an air/fuel line attached to the mixing circuit in order to provide air/fuel for combustion in the combustion chamber.

2. The liquid piston engine-compressor of claim 1, further comprising:

a fuel chamber, wherein the fuel chamber is pressurized to at least 20 psig;

a tube attached to the fuel chamber and the air/fuel mixing circuit.

3. The liquid piston engine-compressor of claim 1, wherein the first diaphragm is a silicone rubber.

4. The liquid piston engine-compressor of claim 1, wherein the second diaphragm is an elastomeric material.

5. The liquid piston engine-compressor of claim 1, wherein the second diaphragm is a metal bellows.

6. The liquid piston engine-compressor of claim 1, wherein a volume of the first transition member is at least equal to a volume of the compression chamber.

7. The liquid piston engine-compressor of claim 1, wherein a weight of the engine-compressor is in a range of from about 1 pound to about 20 pounds.

8. The liquid piston engine-compressor of claim 1, wherein the tube of the liquid piston has a ratio of length to diameter of at least 10.

9. The liquid piston engine-compressor of claim 1, wherein the tube of the liquid piston has a pressure rating of at least 200 psig.

10. The liquid piston engine-compressor of claim 1, wherein the tube of the liquid piston is a thin-walled metal.

11. The liquid piston engine-compressor of claim 1, wherein the tube of the liquid piston is constructed of flexible high-pressure tubing.

12. The liquid piston engine-compressor of claim 1, wherein the tube of the liquid piston has an inner diameter less than a largest inner diameter of either transition member.

13. The liquid piston engine-compressor of claim 1, wherein the first diaphragm has a stiffness of from about 0.2 $Pa/mm^3$ to about 200 $Pa/mm^3$.

14. The liquid piston engine-compressor of claim 13, wherein the second diaphragm has a stiffness of from about 0.2 $Pa/mm^3$ to about 200 $Pa/mm^3$.

15. The liquid piston engine-compressor of claim 1, wherein the first diaphragm and the second diaphragm are oriented so that they flex in opposition of each other in response to combustion in the combustion chamber.

16. The liquid piston engine-compressor of claim 1, wherein the first transition member has a first end and a second end, wherein the first end of the first transition member attaches to the first end of the tube of the liquid piston and the second end of the first transition member is opposite of the first end of the first transition member, wherein the ratio of the cross sectional area of the second end of the first transition member to the cross sectional area of the tube of the liquid piston is from about 2 to about 1000.

17. The liquid piston engine-compressor of claim 1, wherein the second transition member has a first end and a second end, wherein the first end of the second transition member attaches to the second end of the tube of the liquid piston and the second end of the second transition member is opposite of the first end of the second transition member, wherein the ratio of the cross sectional area of the second end of the second transition member to the cross sectional area of the tube of the liquid piston is from about 2 to about 1000.

18. The liquid piston engine-compressor of claim 1, further comprising a compressed natural gas fuel injector.

19. The liquid piston engine-compressor of claim 1, further comprising an inlet valve attached to the engine head so that the combustion chamber is connected to ambient air.

20. A liquid piston engine-compressor, comprising:

a liquid piston, the liquid piston further comprising:

a tube having a first end and a second end;

a first transition member attached to the first end of the tube;

a second transition member attached to the second end of the tube;

a first diaphragm attached to the first transition member;

a solid piston slidably engaging the second transition member, so that the first diaphragm and the solid piston trap a fluid in the tube;

an engine head attached to the first diaphragm of the liquid piston, wherein the engine head and the first diaphragm define a variable volume combustion chamber;

wherein the engine head defines an opening so that a compressed air-fuel mixture of at least 20 psig may pass therethrough;

an ignition device attached to the engine head in order to combust the air-fuel mixture in the combustion chamber;

an exhaust valve attached to the engine head so that combustion byproducts pass through the engine head when the exhaust valve opens;

a variable volume compression chamber, the compression chamber further comprising:

a housing attached to the solid piston of the liquid piston, opposite the second transition member;

an inlet valve attached to the housing;

an outlet valve attached to the housing;

a reservoir, the reservoir further comprising:

a first tube attached to the variable volume compression chamber;

a reservoir body attached to the first tube, wherein the reservoir body is pressurized to at least 20 psig by the compression chamber;

a second tube attached to the reservoir body so that pressurized air is released for use;

a third tube attached to the reservoir body so that pressurized air is released to an air/fuel mixing circuit;

the air/fuel mixing circuit attached to the third tube; and an air/fuel line attached to the mixing circuit in order to provide air/fuel for combustion in the combustion chamber.

21. A liquid piston engine-compressor, comprising:

a liquid piston, the liquid piston further comprising:

a tube having a first end and a second end;

a first transition member attached to the first end of the tube;

a second transition member attached to the second end of the tube;

a first solid piston slidably engaging the first transition member;

a second solid piston slidably engaging the second transition member, so that the first solid piston and the second solid piston trap a fluid in the tube;

an engine head attached to the first solid piston of the liquid piston, wherein the engine head and the first solid piston define a variable volume combustion chamber;

wherein the engine head defines an opening so that a compressed air-fuel mixture of at least 20 psig may pass therethrough;

an ignition device attached to the engine head in order to combust the air-fuel mixture in the combustion chamber;

an exhaust valve attached to the engine head so that combustion byproducts pass through the engine head when the exhaust valve opens;

a variable volume compression chamber, the compression chamber further comprising:

a housing attached to the second solid piston of the liquid piston, opposite the second transition member;

an inlet valve attached to the housing;

an outlet valve attached to the housing;

a reservoir, the reservoir further comprising:

a first tube attached to the variable volume compression chamber;

a reservoir body attached to the first tube, wherein the reservoir body is pressurized to at least 40 psig by the compression chamber;

a second tube attached to the reservoir body so that pressurized air is released for use;

a third tube attached to the reservoir body so that pressurized air is released to an air/fuel mixing circuit;

the air/fuel mixing circuit attached to the third tube; and an air/fuel line attached to the mixing circuit in order to provide air/fuel for combustion in the combustion chamber.

* * * * *